United States Patent [19]

Schmidt et al.

[11] Patent Number: 5,009,237

[45] Date of Patent: Apr. 23, 1991

[54] DEVICE FOR MAKING CIGARETTES

[75] Inventors: Ernst Schmidt, Stuhr; Heinz Stehmeier, Bremen; Heinrich W. Ruppert, Trossingen; Klaus G. Gatschmann, Bad Durrheim; Gunter Schutze, Trossingen, all of Fed. Rep. of Germany

[73] Assignee: Martin Brinkmann AG, Fed. Rep. of Germany

[21] Appl. No.: 652,298

[22] Filed: Sep. 19, 1984

[30] Foreign Application Priority Data

| | | | |
|---|---|---|---|
| Sep. 20, 1983 | [DE] | Fed. Rep. of Germany | 8326921 |
| Nov. 30, 1983 | [DE] | Fed. Rep. of Germany | 3343407 |
| Mar. 19, 1984 | [DE] | Fed. Rep. of Germany | 3410038 |

[51] Int. Cl.[5] ..... A24C 5/00

[52] U.S. Cl. ..... 131/70; 131/71; 131/76

[58] Field of Search ..... 131/70–76

[56] References Cited

U.S. PATENT DOCUMENTS

| | | | |
|---|---|---|---|
| 3,693,630 | 9/1972 | Kastner | 131/70 |
| 3,927,681 | 12/1975 | Bramhill | 131/70 |

FOREIGN PATENT DOCUMENTS

| | | |
|---|---|---|
| 771426 | 11/1967 | Canada . |
| 2064641 | 11/1973 | Fed. Rep. of Germany . |
| 2139242 | 2/1974 | Fed. Rep. of Germany . |
| 2833681 | 2/1980 | Fed. Rep. of Germany . |
| 3135700 | 3/1983 | Fed. Rep. of Germany . |
| 3149584 | 6/1983 | Fed. Rep. of Germany . |

*Primary Examiner*—V. Millin

*Attorney, Agent, or Firm*—Wood, Herron & Evans

[57] ABSTRACT

A device for the do-it-yourself making of cigarettes employs a pre-proportioned tobacco rod (16) which is transferred from a cylindrical rod wrapping (18) into a cigarette paper tube (14) by an axially moveable pusher member (10; 110), which is associated with a tube-like insertion nozzle (12; 112) having an insertion end (6; 106) formed with an outer diameter which is slightly less than that of the cigarette tube (14).

14 Claims, 5 Drawing Sheets

DEVICE FOR MAKING CIGARETTES

The invention relates to a device for the do-it-yourself making of a cigarette by transferring a pre-portioned tobacco rod from a cylindrical rod wrapping into a cigarette paper tube.

There are a series of more or less convenient devices for filling cigarette paper tubes with tobacco, an elongate compression chamber being common to all usual devices, which chamber, on one hand, is defined by a somewhat semi-cylindrical fixed wall part and, on the other hand, by an opposed semi-cylindrical surface of a moveable compression bar by means of which the compression chamber, after being filled with tobacco, can be closed, thus producing a tobacco rod. At a front end of the compression chamber there is provided a plug-in nozzle for filling into and engaging an empty cigarette tube. At its opposite end, the compression chamber is limited by a tobacco ejector slide member by means of which the tobacco rod can be transferred from the compression chamber into the cigarette tube (see e.g. German Patent Application No. 2,833,681; German Patent Nos. 2,139,242 and 2,064,641 and German Patent Application No. 3,135,700).

To increase functional reliability, a half-crescent shell-shaped scoop may be provided at the effective end of the ejector slide member for assisting the transference of the tobacco rod from the compression chamber into the cigarette tube while simultaneously maintaining the stability of the cigarette tube.

These known filling devices have been well proven in practice. However, the disadvantage clings to them that the purchase price for the initial equipment, due to the partly very expensive construction and mechanism for operating the expulsion slide member, is relatively high, so that in this respect inhibition of the consumer must be overcome. Furthermore, during the filling of the compression chamber, a certain contamination of the hands of the user and of the surroundings with tobacco residues cannot be avoided, which is felt to be harmful and which often stops the owner of a filling device from utilizing it. Furthermore, by the manual filling, a uniform degree of filling of the compression chamber and, therewith, of the cigarette tube is not always possible. Cigarettes which have been self-filled in this way are therefore characterized by varying smoking properties, namely varying pull, taste and smoking periods of different lengths. Also, the content of dangerous substances in cigarettes which have been self-filled in the conventional manner differ substantially and in an uncontrolled manner according to the different degrees of filling of the cigarette tubes. This last problem is, in fact, already made known by implication (German Patent Application No. 3,149,584). To overcome this problem, it was therefore proposed to provide a tobacco supply which has been pre-portioned by the manufacturer of the smoking tobacco.

Otherwise, however, as before, the conventional pressure chamber of a filling apparatus is employed, in which the pre-proportioned tobacco supplies are pre-compressed into a tobacco rod and then transferred or pushed from the compression chamber by means of an ejector slide member into the cigarette tube.

From Canadian Patent No. 771,426 there is known a "tobacco cartridge" comprising a tobacco rod in a cylindrical covering (auxiliary packing) which is open at its front end and which is intended to be inserted (as a whole) into pipes. In this way, manual filling of the pipes is avoided. Also, cleaning of the pipes is facilitated by merely removing the covering with the residues of the smoking.

The transference of the contents (tobacco rod) of such a tobacco cartridge from the covering into a cigarette paper tube with the help of a pusher acting axially on the tobacco rod involves difficulties if the outer diameter of the tobacco cartridge corresponds to the inner diameter of the cigarette tube. During the pushing of the tobacco rod from the covering (the tobacco cartridge), the covering must be retained against the frictional forces which occur between it and the tobacco rod. In addition, however, the relative movement of the pusher acting axially on the tobacco rod, relative to the covering, should not be hindered. A further complication is that the covering usually comprises flexible material, which has no resistance to buckling. Therefore, creasing or even tearing of the covering and/or blocking of the ejection movement in the covering can easily occur during the transference.

It is accordingly an object of the present invention to mitigate this nuisance by the assistance of a device which facilitates the transference of the tobacco rod from the covering into the cigarette paper tube.

According to the present invention, there is provided a device for the do-it-yourself making of a cigarette by transferring a pre-portioned tobacco rod from a cylindrical rod wrapping into a cigarette paper tube, which comprises an axially effective pushing member for the tobacco rod, the axially effective pusher member being associated with an insertion nozzle, which is preferably tube-like and the outer diameter of which, at least at the insertion end, is slightly smaller than the inner diameter of the cigarette tube.

Preferably, the insertion nozzle is part of a slide tube which axially slidably guides the axially effective pusher member, which is in the form of a slidable piston, over a part of its length, an insertion end of the insertion nozzle being slidable over the effective end of the cylindrical piston. Thus, the slide tube can have its insertion end inserted into the wrapping of the tobacco cartridge, where it stiffens the latter and forms a fixed support for retaining the wrapping during the transference operation. The accompanying piston movement is not hindered and the wrapping is only subjected, during the transference operation, by the consequentially occurring friction forces, to tension, which even light, flexible wrapping material can withstand without further assistance.

An important further development of the device according to the invention, with a tobacco pusher member which is axially moveable relative to the insertion nozzle, is the retention and, in particular, the rotatable mounting of the insertion nozzle in a frame, bed or housing about its longitudinal axis. By corresponding to- and fro-movement of the insertion nozzle, the fitting and the penetration of the covering filled with tobacco is considerably facilitated. The handling is further considerably facilitated by a clamping device, associated with the insertion nozzle, for fixedly clamping the penetrated covering during the transference of the tobacco rod therefrom into the cigarette tube. Preferably, the clamping device includes at least one clamping element which can be brought into clamping engagement at the outer peripheral surface of the insertion nozzle and which can be actuated manually or by means of a control rail or the like coupled to the axially moveable tobacco pusher member (slide piston). The control rail or a corresponding control linkage can be so constructed that after the filling operation has been finished, or after a complete transference of the tobacco supply into the cigarette tube, the clamping effect is released sufficiently to release the then empty covering.

A pot-shaped recess can be provided on the frame, bed or the like, with the assistance of which the user can easily form a tip on the tobacco cartridge, so that it can more easily be inserted into the cigarette paper tube. A mounting tube, which can be provided additionally or instead of the recess, serves the same purpose.

The cigarette paper tube can be provided with a filter, so that filter cigarettes are produced. A further development of the invention provides, however, a tobacco cartridge in which the tobacco rod is confined at one end of the rod wrapping by a filter member and can be transferred together with the filter member from the rod wrapping into the cigarette paper tube, thus forming a self-made filter cigarette. The filter member then serves, during the transference, to a certain extent as a part of the piston, which apart from this can be a thin rod.

The invention will be more readily understood from the following description of preferred embodiments thereof given, by way of example only, with reference to the accompanying drawings, in which:

as shown in FIGS. 5 to 7, in schematic plan view;

Figure 1:
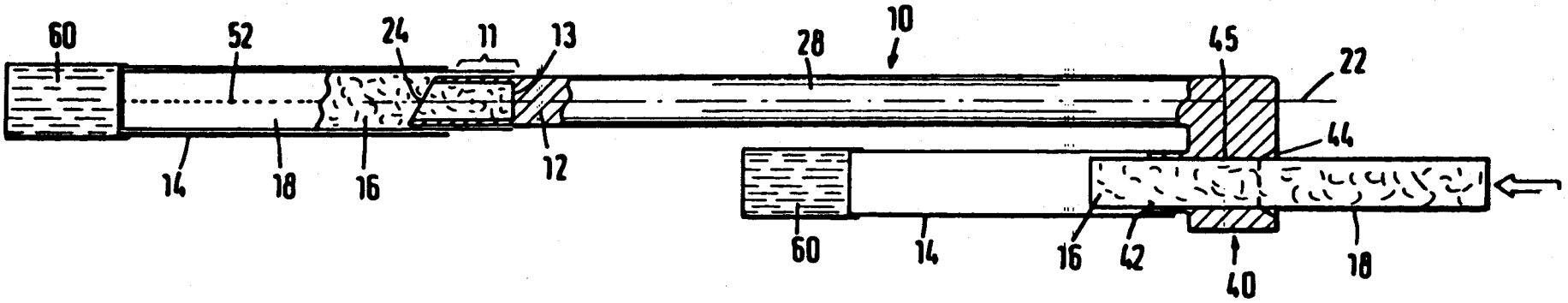
FIG. 1 shows a view taken in cross-section through a cigarette filling apparatus according to the invention, in which the insertion nozzle for the covering filled with tobacco is an integral component of the axially effective tobacco pusher member.
Figure 2:
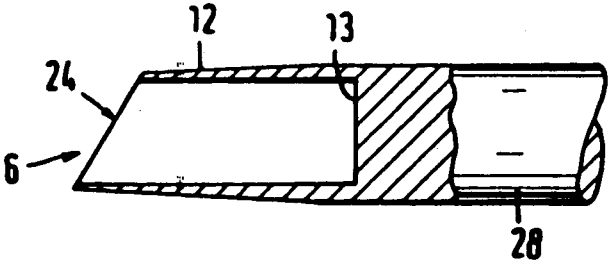
FIG. 2 shows a view in cross-section of the insertion nozzle of the filling apparatus of FIG. 1 on an enlarged scale.

The filling apparatus illustrated in FIG. 1 comprises an axially effective pusher member 10 in the form of a rod of circular cross-section, at the effective end of which there is formed a pot-shaped insertion nozzle 12, the free front surface 24 of which subtends an angle other than 90° with the longitudinal axis 22 of the insertion nozzle 12 or of the rod. As shown in FIG. 2, the outer peripheral surface of the insertion nozzle is formed slightly conical and converges towards the free coupling end, and furthermore is roughened. In this way, the engagement and penetration by the insertion nozzle 12 of an auxiliary wrapping 18, filled with tobacco 16, is facilitated, and in addition an undesired slipping off of the wrapping 18 is prevented. The auxiliary wrapping 18 is made in the form of a cigarette tube and comprises a material which is not intended and is not suitable for smoking, e.g. paper with vapor—deposited or laminated aluminum. It is, furthermore, provided for this purpose with at least one line of perforations 52 extending the entire length thereof. The outer diameter of the auxiliary wrapping 18 is slightly less than the inner diameter of the filter cigarette tube 14, so that the auxiliary packing can be slid without any problem into the cigarette tube 14. As can be seen from FIG. 1, the auxiliary wrapping 18 is so dimensioned that an end section 11 projects from the cigarette sleeve, the length of which is equal to about the width of a finger or to the effective length of the insertion nozzle 12. The inner diameter of the auxiliary wrapping 18 is slightly greater than the outer diameter of the insertion nozzle 12, so that the auxiliary wrapping, filled with tobacco, can be fitted onto the insertion nozzle 12, this fitting being facilitated by the features described with reference to FIG. 2.

The transference of the tobacco supply 16 from the auxiliary wrapping 18 into the cigarette tube 14 is effected by holding the projecting, end section 11 of the auxiliary wrapping 18 between two fingers and sliding the auxiliary wrapping to the right, as viewed in FIG. 1, over the rod which serves as a tobacco pusher member. The tobacco supply 16 abuts the bottom surface 13 of the pot-shaped insertion nozzle 12, so that the tobacco or tobacco rod 16 is pressed out from the auxiliary wrapping 18 and is inserted into the cigarette tube 14.

Preferably, at the end of the rod opposite from the insertion nozzle 12 there is formed a mounting tube 40 for engagement in one another of the auxiliary wrapping 18 filled with tobacco and of the cigarette tube 14, one end of the mounting tube 40 being provided with a holding aid 42 for the cigarette tube 14. The insertion opening 44, opposite from the holding aid 42, for the tobacco-filled auxiliary wrapping 18 is widened somewhat, i.e. bevelled. In this way, the tobacco-filled auxiliary wrapping can easily be inserted into the cigarette tube. Instead of the bevelling of the insertion opening 44, the through-opening 45 of the mounting tube 40, through which the tobacco-filled auxiliary wrapping is pushed, can be formed slightly conical, so as to be convergent towards the holding aid 42.

The rod, including the insertion nozzle 12 and the mounting tube 40, which is not an essential component of the filling apparatus, has a total length of about 80 to 120 millimeters, and thus has the size of a small to middle-sized pocket comb. It is therefore no problem to keep this filling apparatus in the pocket of a jacket or the like.

Figure 3:
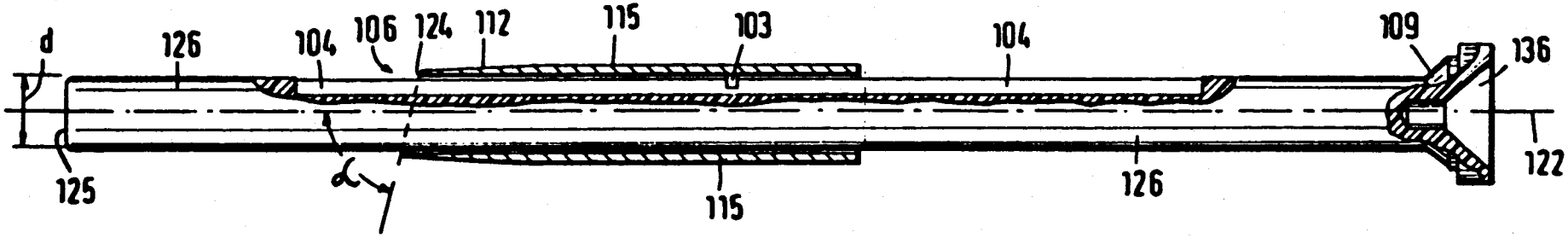
FIG. 3 shows a vertical cross-section through a modified transference device.
Figure 4:
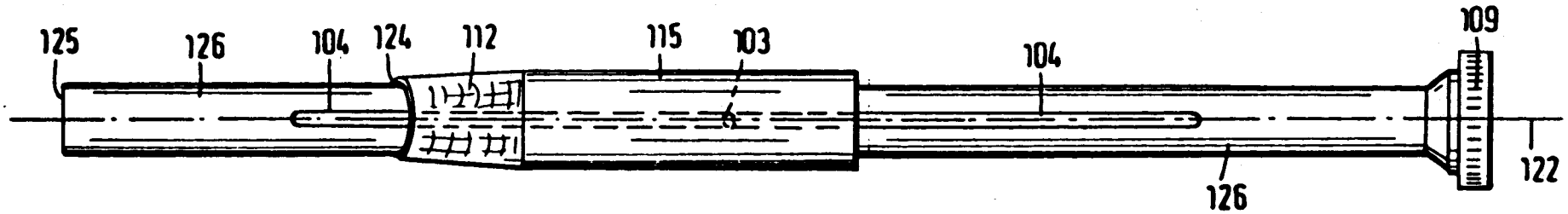
FIG. 4 shows a plan view of the device shown in FIG. 3.

FIGS. 3 and 4 show a filling apparatus in which the axial pusher member has the form of a piston 126 of circular cross-section, which is for example made of plastic material and which is guided so as to be axially slidable in a slide tube 115, which comprises metal. A radially inwardly directed projection on the inner side of the slide tube 115, in the form of a pin 103, projects into a groove 104 which is formed in the piston 126; in this way, the piston 126 and the slide tube 115 are not rotatable relative to one another and the axial relative displacement of the piston 126 relative to the slide tube 115 is limited by the ends of the groove 104. The diameter d of the piston 126 at its effective end 125, i.e. its end which comes into contact with the tobacco rod in the tobacco cartridge, is somewhat smaller than the inner diameter of the cylindrical wrapping of the tobacco cartridge (not shown). In fact, the diameter ratios are so selected (but the device is shown in an enlarged scale in the drawing) that the nozzle section 112, which is slightly conically tapered towards the coupling end 106 of the slide tube 115, can be displaced over a part of its axial length into the cylindrical wrapping of the tobacco cartridge.

FIG. 3 further illustrates that the coupling end 106 of the slide tube 115 projects axially beyond the effective end 125 of the piston 126 when the slide tube 115 assumes its outermost position relative to the piston 126, i.e. the pin 103 of the slide tube 125 abuts the left-hand end, as shown in the drawing, of the groove 104 in the piston 126. Therefore, the slide tube 115 can be inserted, at its coupling end 106, into the tobacco cartridge without contact occurring between the tobacco rod located therein and the piston 126. Only when the cylindrical wrapping of the tobacco cartridge is fixedly held at its corresponding end on the nozzle section 112 of the slide tube 115, and can there be held during the further progress of the transference operation (the nozzle section 112 of the slide tube 115 acting as a counter support), can the piston 126 be displaced through the slide tube 125 into the tobacco cartridge and the tobacco rod ejected at the opposite end, or in other words displaced into the cigarette paper tube which is there held ready.

At its end opposite its effective end 125, there is formed on the piston 126 a widened grip portion 109. In this grip portion 109 there is provided a recess 136, which is substantially conical and aligned with the axis 122 and with the help of which the tobacco cartridge can be formed with a pointed tip before being inserted into the cigarette paper tube.

Figure 5:
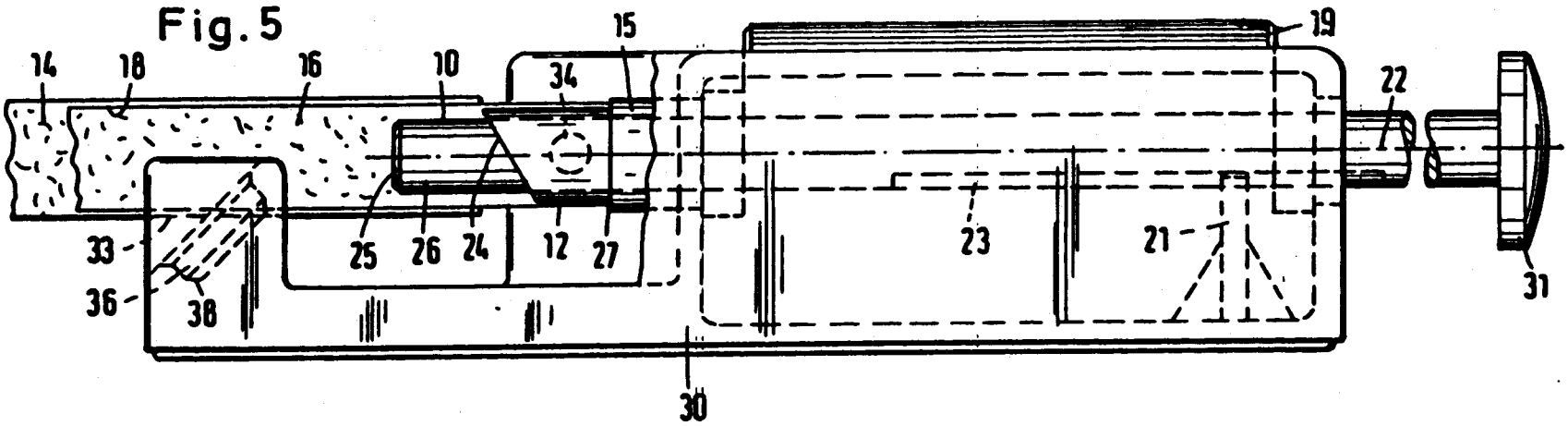
FIG. 5 shows a further embodiment of a filling apparatus according to the invention in side elevation.
Figure 6:
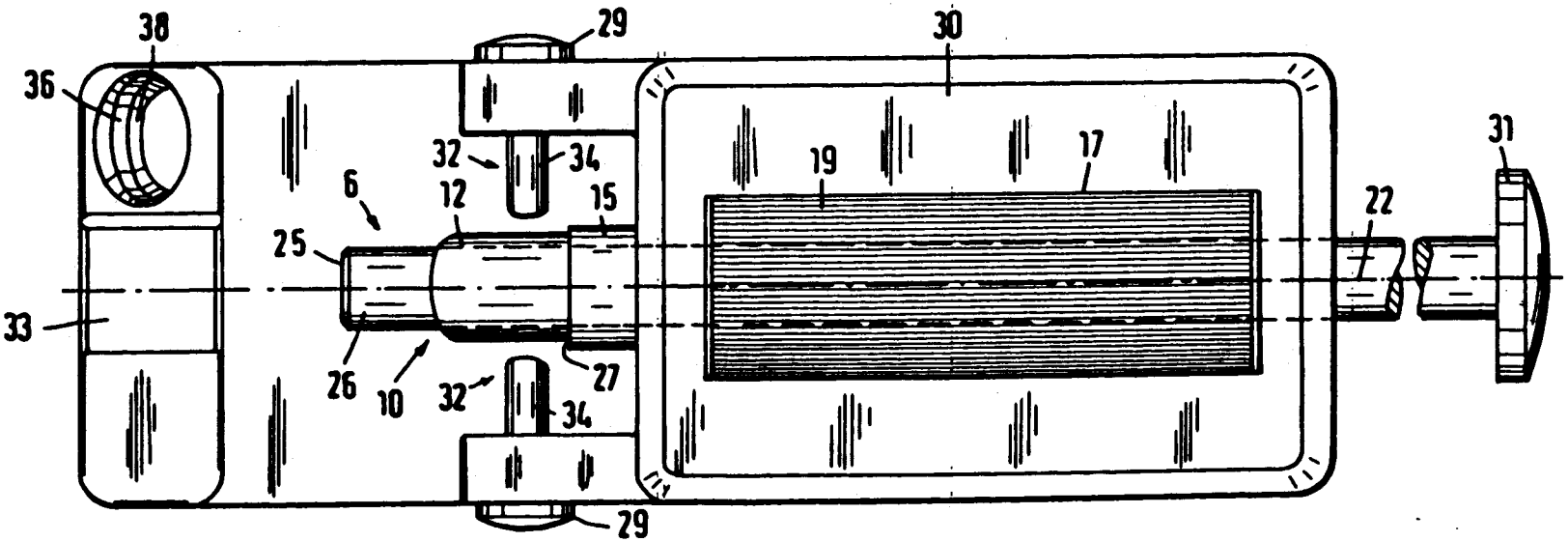
FIG. 6 shows a plan view of the filling apparatus of FIG. 5.
Figure 7:
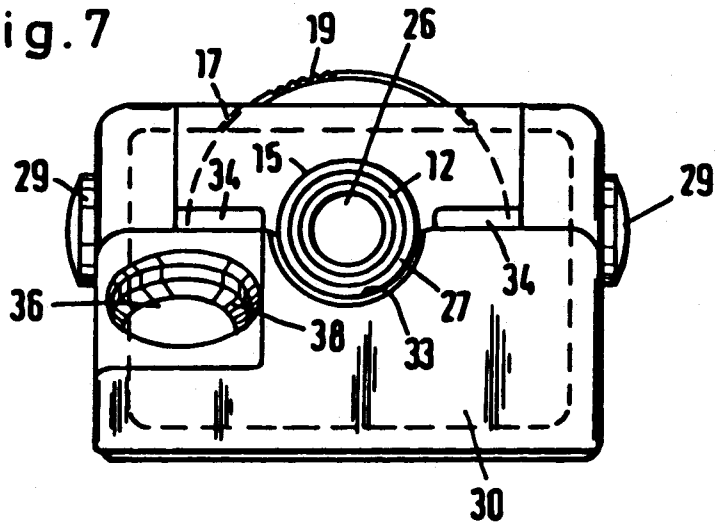
FIG. 7 shows a view in front elevation of the filling apparatus as shown in FIGS. 5 and 6.

The table filling device illustrated in FIGS. 5 to 7 is a further development of the device shown in FIGS. 3 and 4. It comprises a rod-shaped ejector slide member 26, which serves as the axially effective tobacco pusher member 10 and which is guided for axial sliding, over a part of its length, in a slide tube 15, at one end of which is arranged the insertion nozzle 12, which is preferably formed thereon, the insertion nozzle 12 being a part of the slide tube 15. The slide tube 15 and, therewith, the connection nozzle 12 are mounted for rotation to and fro in a housing 30 about the common longitudinal axis 22, through an angle of about 45° to 90°, preferably about 60°, the rotation being limited by abutments formed on the insertion nozzle, which cooperate with corresponding internal parts of the housing (not shown). The top of the housing 30 has an opening 17 through which a gripper member 19, connected to the slide tube 15 and preferably longitudinally ribbed, projects from the housing 30. By an appropriate finger pressure on the gripper member 19, the rotation to and fro of the slide tube 15 and the insertion nozzle 12 can be effected. By this rotation to and fro, the insertion of the insertion nozzle 12 into the tobacco-filled auxiliary wrapping 18 is substantially facilitated, the outer peripheral surface of the insertion nozzle 12, in the embodiment illustrated in FIGS 5 to 7, being formed in a same manner as that of the insertion nozzle 12 illustrated in FIG. 2.

The axial movement of the rod-shaped ejector slide member 26 is limited by an abutment pin 21, which projects into a complementary longitudinal groove 23 in the ejector slide member 26. Simultaneously, the ejector slide member 26 is prevented from rotating. This can, however, also be effected by forming the ejector slide member with a cross section in the form of a cut-off circle (not shown). This arrangement has the advantage that the danger of contamination of the longitudinal groove in the ejector slide member by tobacco residues etc. is avoided.

The ejector slide member 26 in FIG. 5 is slidable to the right so far that its effective end 25 lies within the insertion nozzle 12 and, in fact, so far that the fitting and penetration into the tobacco-filled auxiliary wrapping 18 are not prevented. The effective end 25 of the ejector slide member 26 is located approximately at the height of an insertion abutment 27 for the auxiliary wrapping 18, which is formed as a projection extending around the periphery of the insertion nozzle 12 and is located at a spacing of about a finger width from the free coupling end of the insertion nozzle 12.

With respect to the mounting tube 40 described above with reference to FIG. 1, it is noted that such a tube can also be arranged on the housing 30 of the filling apparatus illustrated in FIGS. 3 to 5. The length of the mounting tube 40 is preferably so dimensioned that in the fully interengaged condition of the cigarette tube and the auxiliary wrapping, the latter projects somewhat from the insertion opening 44 so that the tobacco filled auxiliary wrapping can be moved at the mounting tube 40, by corresponding finger pressure, completely into the tobacco reception space of the cigarette tube.

Instead of the above-mentioned mounting tube 40, the filling apparatus can also be provided with a pot-shaped recess 36 (FIGS. 5 to 7), the bottom edge of which is frusto-conically bevelled (bevel 38). By means of this recess, the tobacco filled auxiliary wrapping can be pointed at its end which is to be inserted into the cigarette tube, the recess 36, with the bottom bevel 38, making possible a defined, uniform tip. The inner diameter of the cup-shaped recess 36 is slightly larger than the outer diameter of the auxiliary wrapping 18.

As can be seen, in particular, from FIG. 6, the insertion nozzle 12 has a clamping device 32 for fixedly clamping the auxiliary wrapping 18. This clamping device comprises two clamping elements 34, which are arranged diametrically opposite and which each can be brought against the action of a resilient element into clamping abutment against the outer peripheral surface of the insertion nozzle 12, the clamping elements 34 having the form of clamping plungers. These clamping elements 34 can be brought manually into their clamping position by exerting or finger pressure on pressure knobs 29 provided on the clamping elements 34.

The ejector slide member 26 has at its end opposite from the effective end 25 a mushroom-like handle 31. Instead of such a handle, the ejector slide member 26 can be provided with a laterally mounted gripping part, a connecting stem between the ejector slide member and the gripping part extending outwardly through a slot formed in the housing and extending parallel to the ejector slide member. The housing slot also serves as a longitudinal guide for the gripping part and for limiting the movement of the ejector slide member. Preferably, the gripping part is formed, in the direction of the longitudinal axis of the ejector slide member 26, with a C-shape and extends over the upper part of the housing 30. In this way the handling of the filling apparatus according to the invention is made more convenient.

The filling device as shown in FIGS. 5 to 7 also has a rest or support 33 for the tobacco cartridge when it is fitted onto the insertion nozzle 12. Instead of this abutment, or an addition thereto, the insertion nozzle 12 can be provided with a guide part to facilitate the coupling of the tobacco cartridge, which guide part comprises a semi-cylindrical guide surface ending directly in front of and closely beneath the guide nozzle 12. As can be seen from FIG. 7, the rest 33 is also semi-cylindrical, so that the tobacco cartridge is supported both underneath and also laterally during the transference of the tobacco supply or rod 16 from the auxiliary wrapping into the cigarette tube.

Figure 8:
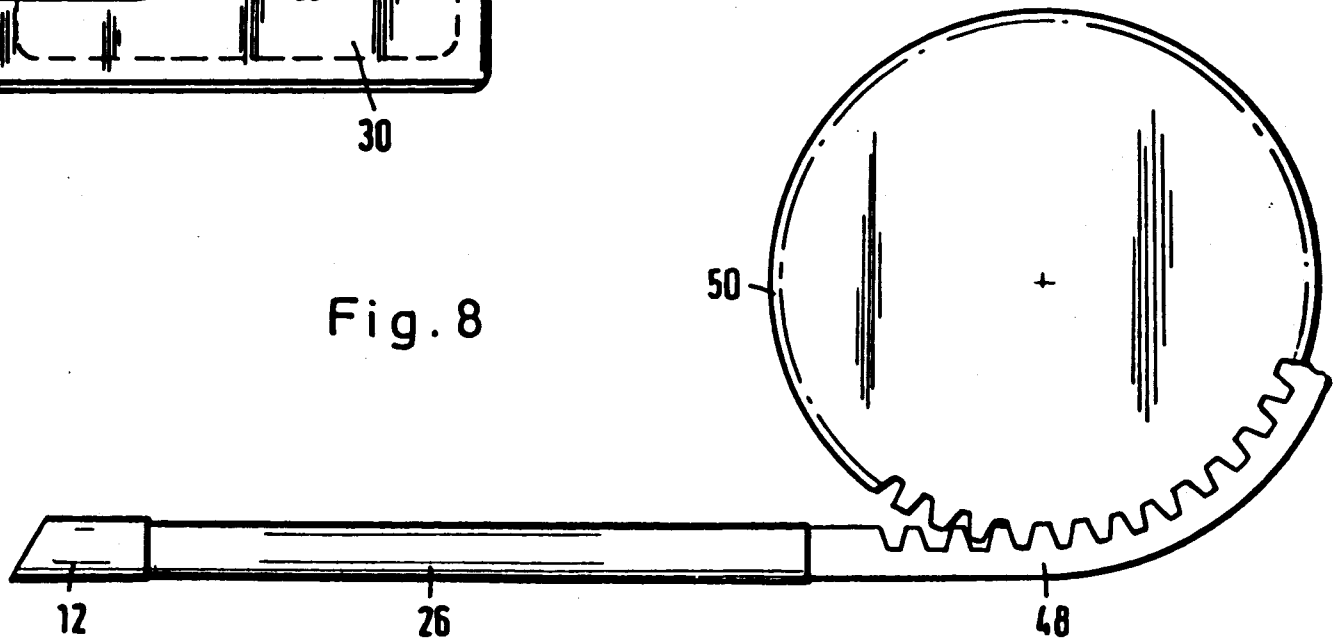
FIG. 8 shows a drive mechanism for the slide piston, e.g.

In FIG. 8 there is shown a particularly convenient actuating mechanism for the ejector slide member 26. This comprises a resiliently bendable toothed rack 48 which, at its end opposite from the effective end of the ejector slide member 26, is fixed and co-operates with an at least partially toothed gear wheel 50. The guiding of the resiliently bendable toothed rack and the engagement of the toothed gear 50 can be constructed similar to the filling device shown in German Patent No. 1,757,977. The drive gear 50 is mounted in the housing 30 so as to be rotatable about a preferably vertical axis and is coupled with an operating lever or operating wheel for corresponding actuation of the ejector slide member. The toothed rack and the drive wheel are suitably so dimensioned that the angle of pivotation of the drive wheel and, thus, of the operating lever or the operating wheel amounts to about 150°. The drive wheel 50 can be replaced by a gear train comprising two or three gears if reduction or step-up gear ratios are required.

At the end opposite from the connection of the toothed rack 48 to the ejector slide member 26, a tension spring or the like can engage the toothed rack 48 so that the ejector slide member, upon release of the operating lever or wheel, is always brought back into a starting position. This can also be effected by a torsion spring engaging and correspondingly acting on the gear wheel 50.

The above-described clamping elements 34 can, in the embodiment with the resiliently bendable toothed rack and gear wheel, preferably be actuated by a control rail or control lever, and in particular an elbow lever with an over-dead-center clamping position, coupled to these drive elements and/or to the operating lever associated with the drive gear 50.

Basically, a kind of "blow tube" embodiment is also conceivable, i.e., a rod of circular cross-section with a longitudinal boring substantially in the vicinity of the longitudinal central axis. After impaling the tobacco cartridge on the coupling end of the rod, which in this embodiment preferably comprises an insertion tube as shown in FIGS. 1 and 2, the tobacco supply is duly "shot" or "blown" from the auxiliary wrapping 18 into the cigarette tube 14 by means of compressed air passing through the longitudinal boring. For this purpose, the rod can be coupled, at its end opposite from the coupling end, with a mouthpiece for easier "mouth blowing" or to a piston and cylinder unit providing a pulse of compressed air, which can be an integral component of the rod.

Figure 9:
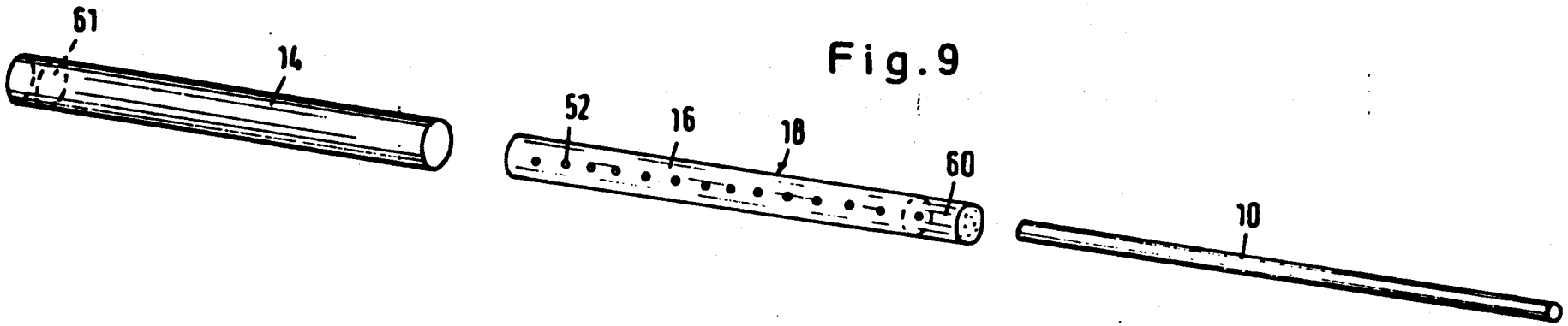
FIG. 9 shows a view in perspective of a system for the making of a filter cigarette by the consumer with a novel tobacco cartridge, the filter member of which, during transference, forms of a part of the filling device.

FIG. 9 shows, in a separated condition, a system for do-it-yourself production of a filter cigarette by a consumer from a factory-prepared filterless cigarette paper tube 14, of which the end, shown at the left in FIG. 9, is closed by an auxiliary plug 61. This plug 61 is an advantageous, but not essential, feature. The tobacco rod 16 is suitably packed somewhat less densely into the non-smokable rod wrapping 18 than in a normal cigarette and than is desired for the final self-made cigarette. The end, shown at the right in FIG. 9, of the rod wrapping 18 is closed by a filter member 60 of conventional type. The rod wrapping 18 is formed with a diameter somewhat smaller than the conventional cigarette paper tube 14 in such a way that the tobacco rod 16, including the rod wrapping 18, can easily be inserted into a conventional cigarette paper tube 14 (see also FIG. 10).

As a further component, the system according to the invention also comprises a rod 10 of wood, plastic or the like, the outer diameter of which can, if required, also be substantially smaller than the end diameter of the rod wrapping 18.

Figure 10:
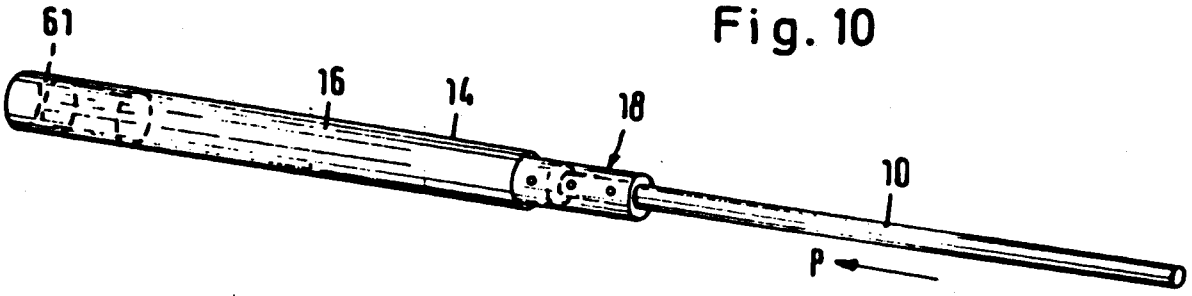
FIG. 10 shows the utilization of the system in a second stage of the production of a filter cigarette by the consumer.

As shown in FIG. 10, the wrapped tobacco rod 16 is inserted into the cigarette paper tube 14 and, in fact, with the filter-free end disposed forwardly, until it strikes against the auxiliary plug 61. As can be seen from FIG. 10, the tobacco rod projects, coupled with its filter piece 60, in the fully inserted condition from the end of the cigarette paper tube opposite from the plug 61. At this end, on transference of the tobacco rod 16 together with the filter member 61 into the cigarette paper tube 14, the rod wrapping 18 can be fixedly retained. The transference of the tobacco rod 16 together with the filter member 16 to the cigarette paper tube 14 is effected by means of the rod 10, which is placed against the filter member 60 and pressed into the rod wrapping 18 in the direction of the arrow P. The tobacco rod 16 is thereby pushed out of the opposite end of the rod wrapping 18 while simultaneously filling the cigarette paper tube 14. The tobacco rod 16, which preferably is somewhat long corresponding to the somewhat looser filling of the rod wrapping 18, can be so compressed by the filter piece 60, serving as a piston, that a tight filling of the cigarette paper tube, corresponding to the conventional factory-produced cigarette, is produced and the tobacco filling, in the finished condition, terminates just at the end of the cigarette paper tube 14.

Figure 11:
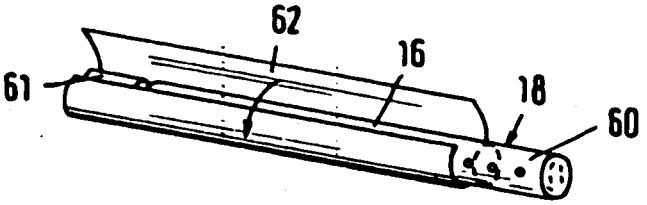
FIG. 11 shows the use of the system in association with a cigarette paper of the type conventionally used in the self-rolling of cigarettes.

The above described system is suitable, as shown in FIG. 11, also in association with cigarette paper sheets such as are used in a conventional manner for the self-rolling of cigarettes. A cigarette paper sheet 62 is wound around the tobacco rod 16 located, together with the filter member 60, in the rod wrapping 18 and is adhered as usual. Then, the tobacco rod (including the filter member 60 and the plug 61) are pushed out using the rod 10, which is not illustrated in FIG. 11.

We claim:

1. A device for the do-it-yourself making of a cigarette by transferring a pre-portioned tobacco rod from a cylindrical wrapping into a cigarette tube comprising:
   - an axially moveable pusher member having an effective end for engaging the tobacco rod;
   - and axially moveable insertion nozzle being insertable into said cigarette paper tube in advance of said effective end of the pusher member;
   - said insertion nozzle being of hollow tubular configuration and having an insertion end of smaller diameter than the cigarette paper tube.

2. A device as claimed in claim 1, wherein said insertion nozzle is slightly conical and convergent towards said insertion end.

3. A device as claimed in claim 1, wherein the exterior of said insertion nozzle is roughened.

4. A device as claimed in claim 1, wherein said insertion nozzle has a front face at said insertion end which is inclined relative to the longitudinal axis of said insertion nozzle.

5. A device as claimed in claim 1, including a mounting tube for receiving a rod wrapping filled with a tobacco rod, means for holding a cigarette paper tube adjacent to one end of said mounting tube.

6. A device for the do-it-yourself making of a cigarette by transferring a pre-portioned tobacco rod from a cylindrical rod wrapping into a cigarette paper tube comprising:

an annular moveable pusher member having effective end for engaging the tobacco rod;

an axially moveable insertion nozzle, said insertion nozzle being of tubular configuration and having an insertion end the outer diameter of said insertion end being slightly smaller than the inner diameter of the cigarette tube, a slide tube for axially slidably guiding said pusher member, said pusher member including a slidable piston portion, said insertion end of said nozzle being slidable over the effective end of said piston portion of said pusher member.

7. A device as claimed in claim 6 further including a frame, said slide tube being supported on said frame, a clamping device carried by said frame for fixedly clamping the rod wrapping.

8. A device as claimed in claim 7, wherein said slide tube is mounted so as to be rotatable about its longitudinal axis.

9. A device as claimed in claim 6 further including a member, having a pot-shaped recess which is at least partially frusto-conical and the inner diameter of which is slightly larger than the outer diameter of said rod wrapping.

10. A device as claimed in claim 6, wherein said slidable piston is non-rotatably guided in the slide tube.

11. A device as claimed in claim 6 further comprising a bendable toothed rack, said slide piston being connected to said bendable toothed rack, a drive gear wheel, rotatably mounted on said frame, said rack meshing with said drive gear wheel and means for rotating said drive gear wheel.

12. A tobacco cartridge for use with a device for the do-it-yourself making of a cigarette by transferring a proportioned tobacco rod from a cylindrical rod wrapping into a cigarette paper tube said cartridge comprising:

a nonsmokable rod wrapping having an open front end;

a tobacco rod disposed within said wrapping and being transferable into a cigarette paper tube, the diameter of said rod wrapping being smaller than the diameter of said cigarette paper tube;

a filter member slidably disposed within said rod wrapping, said tobacco rod being confined at one end of said rod wrapping by said filter member and being transferable together with said filter member from said rod wrapping into said cigarette paper tube, thereby forming a self-made filter cigarette.

13. A tobacco product as claimed in claim 12, wherein said filter member is provided with expansion pleats, which are substantially uniformly distributed over the periphery of said filter member, and are slightly radially compressed.

14. A tobacco product for use with a device for the do-it-yourself making of a cigarette by transferring a proportioned tobacco rod from a cylindrical rod wrapping into a cigarette paper tube;

said tobacco product comprising a cartridge and a cigarette paper tube having an insertion end;

said cartridge comprising a nonsmokable rod wrapping having an open front end;

a tobacco rod disposed within said wrapping and being transferable into said cigarette paper tube through said insertion end, the diameter of said rod wrapping being smaller than the diameter of said cigarette paper tube;

a filter member slidably disposed within said rod wrapping, said tobacco rod being confined at one end of said rod wrapping by said filter member and being transferable together with said filter member from said rod wrapping into said cigarette paper tube, thereby forming a self-made filter cigarette;

an auxiliary plug being disposed within said cigarette paper tube at a second end remote from said insertion end, said auxiliary plug plug closing said second end for said wrapped tobacco rod, said plug being slidable within said cigarette paper tube whereby during the final phase of transference of said tobacco rod said plug is pushed from said cigarette paper tube.

* * * * *